US009455537B2

(12) United States Patent
Scholeno

(10) Patent No.: US 9,455,537 B2
(45) Date of Patent: Sep. 27, 2016

(54) ELECTRICAL CONNECTOR LOCK

(71) Applicant: Michael Scholeno, York, PA (US)

(72) Inventor: Michael Scholeno, York, PA (US)

(73) Assignee: FCI Americas Technology LLC, Carson City, NV (US)

( * ) Notice: Subject to any disclaimer, the term of this patent is extended or adjusted under 35 U.S.C. 154(b) by 0 days.

(21) Appl. No.: 14/461,526

(22) Filed: Aug. 18, 2014

(65) Prior Publication Data

US 2015/0056854 A1 Feb. 26, 2015

Related U.S. Application Data

(60) Provisional application No. 61/869,360, filed on Aug. 23, 2013.

(51) Int. Cl.

| | |
|---|---|
| ***H01R 13/6595*** | (2011.01) |
| *H01R 24/64* | (2011.01) |
| *H01R 13/514* | (2006.01) |
| *H01R 13/66* | (2006.01) |
| *H01R 13/518* | (2006.01) |
| *H01R 13/73* | (2006.01) |
| *H01R 13/6587* | (2011.01) |

(52) U.S. Cl.

CPC ..... *H01R 13/6595* (2013.01); *H01R 13/514* (2013.01); *H01R 13/518* (2013.01); *H01R 13/6587* (2013.01); *H01R 13/6658* (2013.01); *H01R 13/73* (2013.01); *H01R 24/64* (2013.01); *Y10T 29/49147* (2015.01)

(58) Field of Classification Search

CPC .. H01R 13/518; H01R 13/514; H01R 24/64; H01R 13/73; H01R 13/6658

USPC ..... 439/540.1

See application file for complete search history.

(56) References Cited

U.S. PATENT DOCUMENTS

2007/0184700 A1* 8/2007 Swanson ..... H01R 4/46 439/260

2014/0073183 A1* 3/2014 Golko ..... H01R 13/6594 439/607.34

* cited by examiner

*Primary Examiner* — Abdullah Riyami
*Assistant Examiner* — Justin Kratt
(74) *Attorney, Agent, or Firm* — Wolf, Greenfield & Sacks, P.C.

(57) ABSTRACT

An electrical connector lock can include a mounting member configured to attach to a substrate. The electrical connector lock can also include force cancellation member that cancels forces generated on an electrical component by a mated component.

13 Claims, 6 Drawing Sheets

ELECTRICAL CONNECTOR LOCK

CROSS-REFERENCE TO RELATED APPLICATIONS

This claims priority to U.S. patent application Ser. No. 61/869,360 filed Aug. 23, 2013, the disclosure of which is hereby incorporated by reference as if set forth in its entirety herein.

FIELD OF THE DISCLOSURE

The present disclosure relates to strain force relief for a board mounted electrical connector.

BACKGROUND

Some substrates, PCB, or board mounted electrical connectors, such as MiniSAS HD connectors, receive a corresponding transceiver. When sufficient stress or strain is applied to a cable extending from a non-mating end of the transceiver, a moment can develop. The moment can translate to a force that is transferred from the transceiver to the connector or the connector and cage of the board mounted electrical connector. The more transceivers and cables that the electrical connector can receive, such as 1×N or N×N, the more potential connector and cage removal force. The removal force can rip the electrical connector or the electrical connector and the cage from a mounting substrate. The force can also deform or damage the electrical connector, the cage, or both.

SUMMARY

In one embodiment, an electrical connector lock can be configured to prevent removal of at least one electrical connector from a substrate to which the electrical connector is mounted. The electrical connector lock can include at least one mounting member that is configured to attach to the substrate, and a force cancellation member that is positioned such that at least a portion of the at least one electrical connector is disposed between the force cancellation member and the substrate when the mounting member is attached to the substrate. Thus, the force cancellation member can be configured to apply a cancellation force to the electrical connector in response to a separation force that is applied to the at least one electrical connector in a direction away from the substrate.

DETAILED DESCRIPTION

Figure 1A:
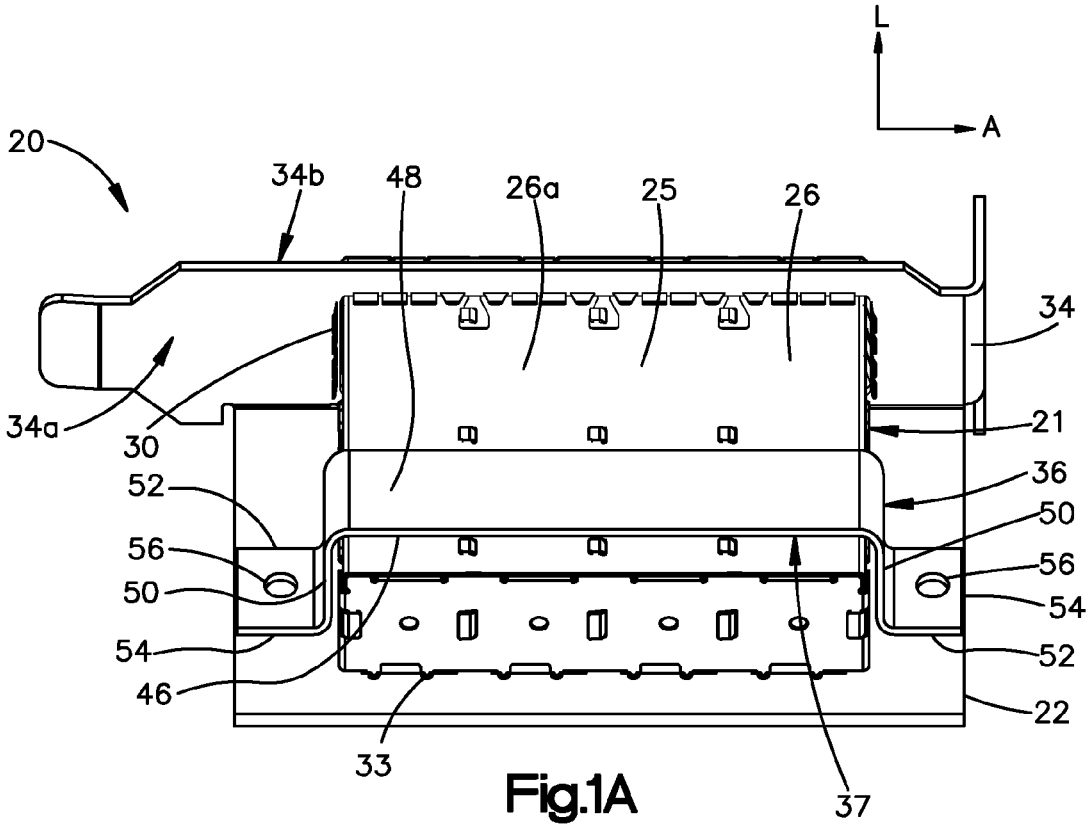
FIG. 1A is top plan view of an electrical assembly including a substrate, a plurality of electrical connectors mounted to the substrate, a cage that surrounds the electrical connectors, and an electrical connector lock constructed in accordance with one embodiment.
Figure 1C:
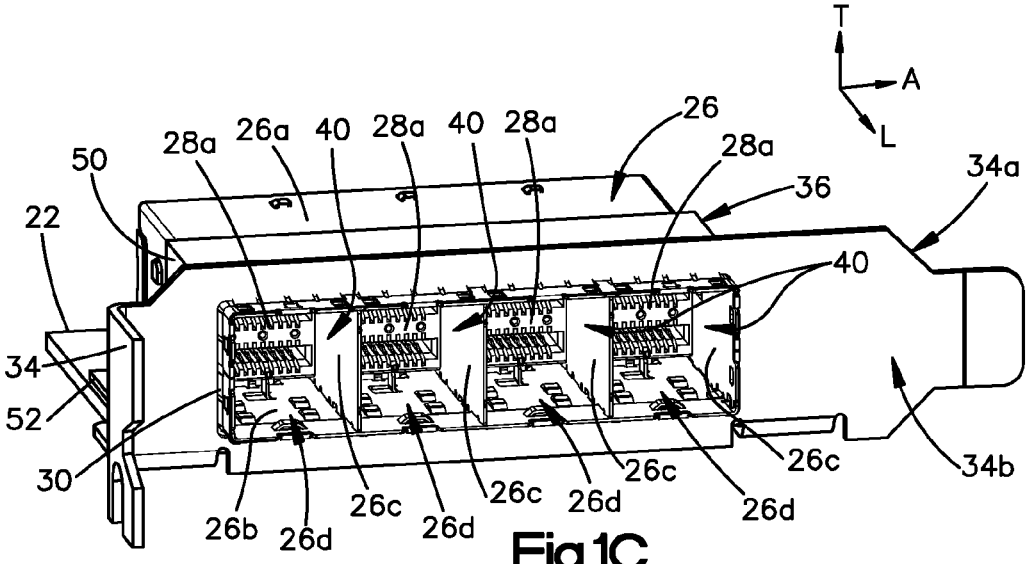
FIG. 1C is a perspective view of the electrical assembly illustrated in FIG. 1A.
Figure 1B:
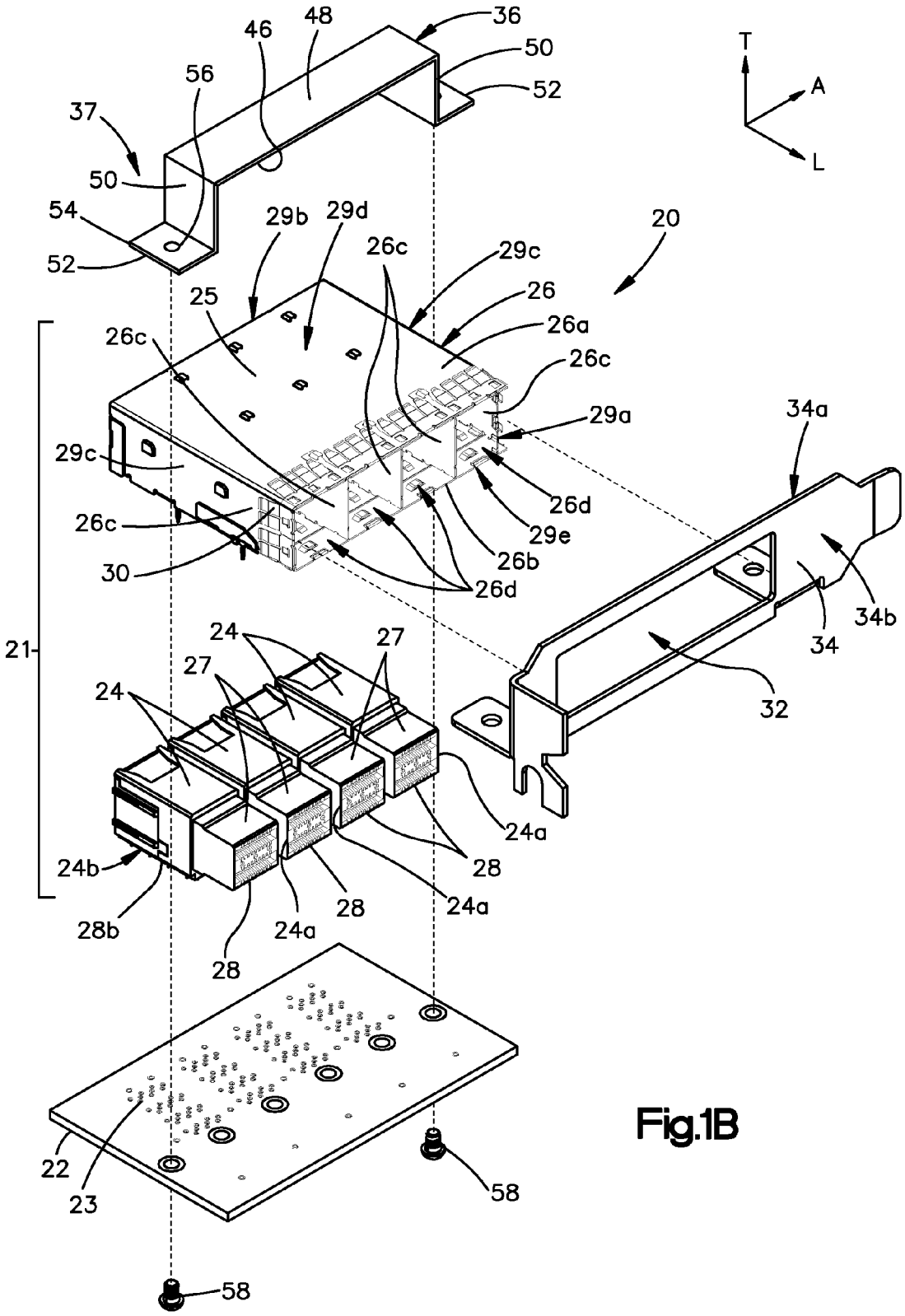
FIG. 1B is an exploded perspective view of the electrical assembly illustrated in FIG. 1A.
Figure 1D:
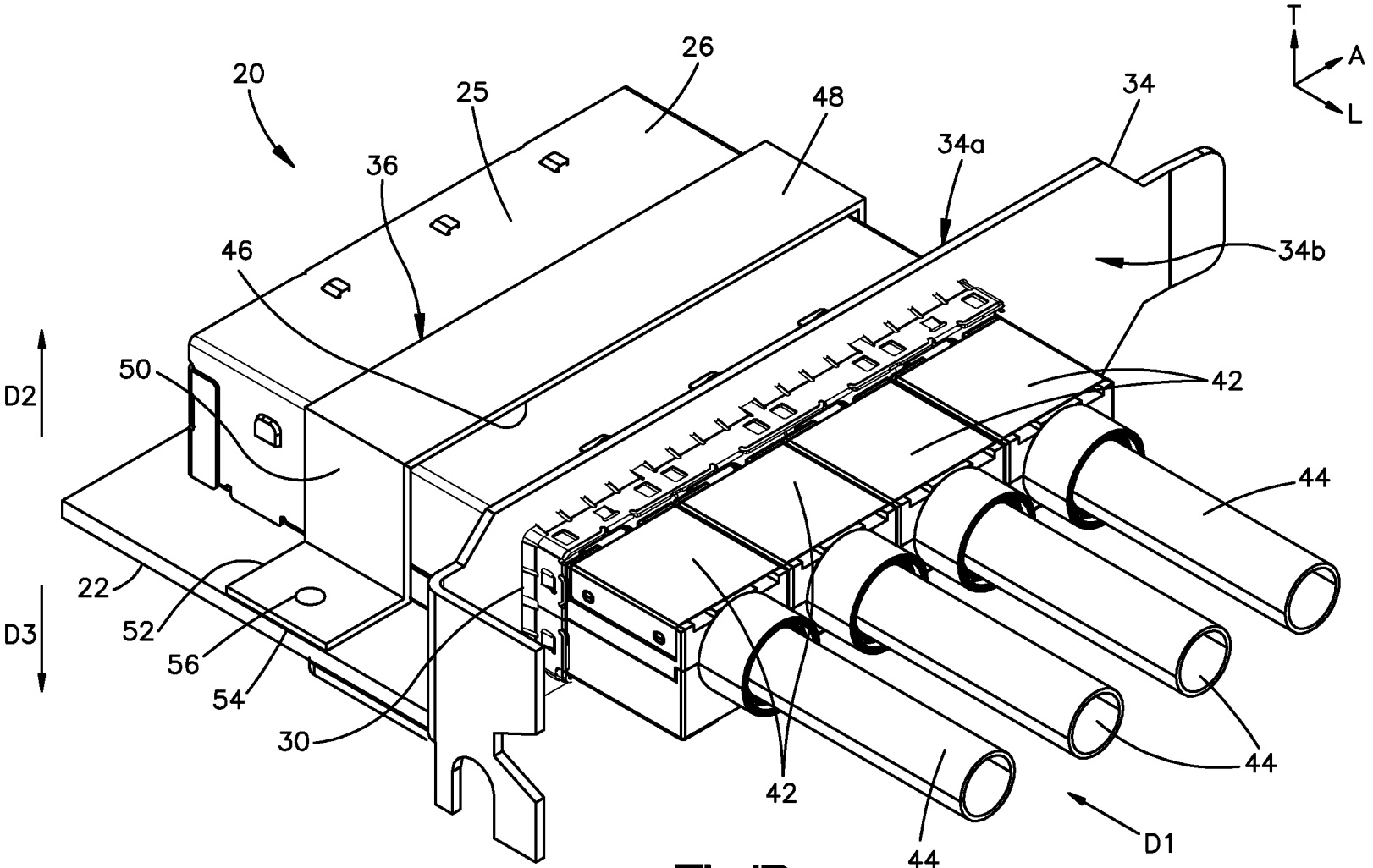
FIG. 1D is a perspective view of the electrical assembly illustrated in FIG. 1A, but showing transceivers mated to the electrical connectors.

As a general overview, electrical connector locks are disclosed that are configured to mount to a substrate, and are further configured to operatively engage an electrical component that can include one or both of an electrical connector and a cage that surrounds the electrical connector. The electrical component may be a press-fit mounted electrical connector, a surface mounted electrical connector, a press-fit mounted electrical connector, a cage physically attached to the press-fit mounted electrical connector or a surface mounted electrical connector and a cage physically attached to the surface mounted electrical connector. Both the electrical connector and the cage are configured to be mounted to the substrate. The electrical connector locks can be configured as a bracket, and can include at least one force cancellation member. When the electrical connector locks operatively engage the electrical component, the force cancellation member is configured to cancel forces generated on the electrical component by a complementary electrical connector that is mated to the electrical connector of the electrical component. Thus, the electrical connector lock may help to prevent removal of the electrical component from a substrate to which the electrical component is mounted. It will thus be appreciated that the force cancellation member is configured to cancel forces generated on a component by a mated component. As will be appreciated from the description below, the force cancellation member can include a bar, force cancellation member, spring, piston, counterweight, or the like, or any combination thereof.

Referring now to FIGS. 1A-1D, an electrical assembly 20 can include an electrical component 21 that is configured to be mounted to a substrate 22, which can be configured as a printed circuit board. The electrical assembly 20 can further include the substrate 22 in accordance with certain embodiments. The substrate 22 can be configured as a printed circuit board. The electrical component 21 can include at least one electrical connector 24 and a cage 26. For instance, the electrical component 21 can include a plurality of electrical connectors 24. The electrical component 21 can include a plurality of cages, or a single cage that is divided so as to surround each of the electrical connectors 24. For instance, the cage 26 can include an upper wall 26*a*. The cage 26 can further include a lower wall 26*b* spaced from the upper wall 26*a* along a transverse direction T. The cage can further include a plurality of side walls 26*c* that extend down from the upper wall 26*a* along the transverse direction. For instance, the side walls 26 can extend between the upper wall 26*a* and the lower wall 26*b*. In one example, the side walls 26*c* can extend from the upper wall 26*a* to the lower wall 26*b*. The side walls 26*c* can be spaced from each other along a lateral direction A that is perpendicular to the transverse direction T so as to define a retention void 26*d* between adjacent ones of the side walls 26*c*. The retention voids 26*d* can further be defined by the upper wall 26*a*. The retention voids 26*d* can further be defined by the lower wall 26*b*. Thus, each retention void 26*d* can be defined between a pair of opposed side walls. 26*c*.

Each of the electrical connectors 24 is configured to be mounted to the substrate 22. When the electrical connectors 24 are received in respective ones of the retention voids 26*d*, the cage 26 substantially surrounds the electrical connector 24 to provide electrical shielding between adjacent ones of the electrical connectors 24 and other nearby electrical components. The cage 26 includes a plurality of EMI (electromagnetic interference) shielding fingers 30 that are received in an opening 32 of an electrically conductive panel 34. The fingers 30 can extend from the outermost side walls 26*c* with respect to the lateral direction A, the upper wall 26*a*, or a combination thereof. Thus, the electrical connector 24 and the cage 26 can be supported by the panel 34, and can extend from a first side 34*a* of the panel 34. The electrical assembly 20 can further include the panel 34 in accordance with certain embodiments.

The fingers 30 can be disposed at a front end 29*a* of the cage 26. The cage 26 further defines a rear end 29*b* spaced from the front end 29*a* along a longitudinal direction L that is perpendicular to both the transverse direction T and the lateral direction A. The rear end 29*b* is spaced from the front end 29*a* in a rearward direction that is defined as a direction from the panel 34 toward the rear end 29*b*. Thus, the front end 29*a* is spaced from the rear end 29*b* in a forward direction, opposite the rearward direction. Thus, the forward direction is defined as a direction from the rear end 29*b* toward the panel 34. The cage 26 further defines opposed sides 29*c* that are spaced from each other along the lateral direction A. The cage 26 further defines an upper end 29*d* and a lower end 29*e* spaced from each other along the transverse direction T. The upper end 29*d* can be defined by the upper wall 26*a*. The lower end 29*e* can be defined by the lower wall 26*b*. The upper end 29*d* can be said to be spaced upward with respect to the lower end 29*e*. Similarly, the lower end 29*e* can be said to be spaced down with respect to the upper end 29*d*.

It will be appreciated that each of the electrical connectors 24 is configured to mate with a complementary electrical connector that can apply a force to the electrical connectors 24 that urges the electrical connectors 24, and thus the cage 26, away from the underlying substrate 22. The force can be applied both while the electrical connectors are being mated, or after the electrical connectors have been mated. The electrical assembly 20 can further include an electrical connector lock 36 that is configured to secure the electrical component 21 to the substrate 22. For instance, the electrical connector lock 36 is configured to be mounted to the substrate 22, so as to apply a cancellation force to the electrical component 21 that acts against the biasing force applied by the complementary electrical connector. It will be appreciated that an electrical connector assembly 37 can include the electrical connector lock 36 and the electrical component 21. The electrical connector lock 36 can be made from metal, plastic, or other suitable material as desired.

The electrical connector 24 can be configured as a MimiSAS HD connector, and includes a dielectric or electrically insulative connector housing 27. The electrical connector 24 defines a mating interface 24*a* configured to mate with the complementary electrical connector, and a mounting interface 24*b* configured to be mounted to the substrate 22. The electrical connector 24 can define a receptacle 40 in the connector housing 27 at the mating interface 24*a*. The receptacle 40 of each electrical connector 24 is configured to receive a respective complementary electrical connector, which can be configured as an optical or copper transceiver 42, thereby mating the electrical connector 24 to the transceiver 42. Thus, the electrical assembly 20 can include at least one transceiver 42, such as a plurality of transceivers 42, in certain embodiments. In accordance with one embodiment, the electrical connector 24 can be mated with the transceiver 42 along a mating direction D1. The mating direction D1 can be oriented in a longitudinal direction L that is perpendicular to both the transverse direction T and the lateral direction A. For instance, the electrical assembly 20 can be supported by the panel 34 as described above, and the transceivers 42 can be inserted through the panel 16, into respective ones of the retention voids 26*d*, and into the corresponding receptacle 40 along the longitudinal direction L so as to mate with the respective electrical connector 24. Thus, a mating end of the transceiver 42 electrically and physically connects to the electrical connector 24 and is partially electrically shielded by the cage 26. It should be appreciated that the transceiver 42 is supported at a second side 34*b* of the panel 34 opposite the first side 34*a*. At least one cable 44, such as a single cable, or a pair of cables, which can be optical cables, copper cables, or the like, extends out from the transceiver 42. The electrical connector 24 further defines a plurality of electrical contacts 28 supported by the connector housing 27 that are configured to be placed in electrical communication with the transceiver 42 when the transceiver 42 is mated to the electrical connector 24. Thus, when the electrical connector 24 is mated to the transceiver 42, the electrical contacts 28 are placed in signal communication with the cables 44.

The electrical connector 24 further defines a mounting interface 24*b* that is configured to be mounted to the substrate 22. The electrical connector 24 can be configured as a right-angle electrical connector, whereby the mounting interface 24*b* is oriented perpendicular to the mating interface 24*a*. Thus, the substrate 22 can be disposed adjacent the electrical connectors 24 in a downward direction, which is along the transverse direction T. The electrical connector 24 can be mounted to the substrate 22 by relative motion of the electrical connector 24 relative to the substrate 22 in the downward direction. Alternatively, the electrical connector 24 can be configured as a vertical electrical connector, whereby the mounting interface 24*b* is oriented parallel with the mating interface 24*a*. The electrical contacts 28 define mounting ends 28*a* that extend out from the connector housing 27 at the mounting interface 24*b*, and are configured to be mounted onto the substrate 22. For example, the mounting ends 28*a* can be configured as press-fit tails that are press-fit into corresponding vias 23 of the substrate 22. Alternatively, the mounting ends 28 can be configured as compression leads or compliant leads that are configured to be placed against respective contact pads of the substrate 22.

Alternatively, the mounting ends 28*a* can be configured to be surface mounted to the substrate 22. For instance, the mounting ends 28*a* can be configured as wave solder or solder balls configured to be fused to respective contact pads of the substrate 22. The cage 26 can include press-fit tails 39 that are press-fit into respective openings of the substrate 22. Alternatively, the cage 26 can be surface mounted to the substrate 22 as described above with respect to the electrical connector 24. Alternatively or additionally still, fasteners 49 (see FIGS. 3B and 4A) can extend through the substrate 22 and into the lower wall 26*b* of the cage so as to attach the cage 26 to the substrate 22. The fasteners 49 can be configured as screws, pins, nails, rivets, or the like. It should be appreciated in FIGS. 3B and 4A that the electrical assembly 20 can be devoid of the fasteners 49 as desired. In one embodiment, both the electrical connector 24 and the cage 26 are mounted to the substrate 22 by respective press-fit pins 33 that are each received in a respective plated through hole of the substrate 22. Alternatively or additionally, one or more fasteners, such as screws, rivets, or the like, can extend through the substrate 22 and into the cage 26 so as to mount the cage 26 to the substrate 22.

It is recognized that application of a force F to the cables 42 in the downward direction at the second side 34*b* of the panel can cause a moment of force that is applied to the electrical connectors 24 and the respective cage 26. The moment of force biases the electrical connectors 24 and the respective cage 26 in an upward separation direction D2 that is opposite the downward direction. Thus, the moment applies a separation force to the electrical connectors 24 and the cage 26 along the separation direction D2 away from the substrate 22. With continuing reference to FIGS. 1A-1D, and as described above, the electrical assembly 20 can further include an electrical connector lock 36 that is configured to secure the electrical component 21 to the substrate 22, and prevent separation of either or both of the electrical connector 24 and the cage 26 from the substrate 22. The electrical connector lock 36 is attached to the substrate 22, for instance, at one or more locations that do not interfere with substrate electrical trace routing associated with the at least one electrical connector 24. Thus, it can be said that the electrical connector lock 36 is configured to apply a cancellation force to either or both of the cage 26 and the electrical connectors 24, either directly or indirectly, in a retention direction D3, which is in the downward direction. Thus, the cancellation force can be oriented toward the substrate 22.

In a first embodiment, the electrical connector lock 36 defines a force cancellation surface 46 that is configured to apply the cancellation force to one or both of the cage 26 and the at least one electrical connector 24 in the direction D3 that is opposite to the separation force (180 degrees opposite to the D2 direction) generated when the transceiver presses on the cage 14 in the direction Ds direction. The cancellation force can further be equal to the separation force. The cancellation force can be applied by the force cancellation surface 46 directly or indirectly to one or both of the cage 26 and the at least one electrical connector 24. For instance, the force cancellation surface 46 can apply the cancellation force directly to the cage 36, and indirectly to the at least one electrical connector 24. For example, the cage 36 can receive the cancellation force from the force cancellation surface 46 and, in turn, apply the cancellation force to the at least one electrical connector 24. It should be appreciated that at least a portion of the connector housing 27 up to an entirety of the connector housing 27 is disposed between the force cancellation member 48 and the substrate 22. Further, at least a portion of the at least one electrical connector, with the exception of any portions of the electrical contacts and the connector housing 27 that extend into the substrate 22, can be disposed between the force cancellation member 48 and the substrate 22. It should be further appreciated that at least a portion of the cage 26, up to an entirety of the cage 26, can be disposed between the force cancellation member 48 and the substrate 22.

The force cancellation surface 46 can apply the cancellation force to a cage surface 25 of the cage 26. Because the force cancellation surface 46 can apply the cancellation force to a cage surface 25 of the cage 26, the force cancellation surface 46 can be said to apply the cancellation force to the electrical component 21. Thus, the cage surface 25 can be disposed between the force cancellation surface 46 and the substrate 22. The cage surface 25 can be oriented perpendicular to the transverse direction T, and thus perpendicular to the upward direction D2 and the downward direction D3. It is appreciated that while the terms "upward" and "downward" and derivatives thereof are used with respect to the orientation of the electrical assembly 20 as illustrated, the orientation of the electrical assembly 20 can vary during use, and these directional terms are intended to apply to the connector assembly 20 in all orientations. The cage surface 25 can be oriented parallel to the substrate 22. Further, the cage surface 25 can be oriented parallel to the mounting interfaces 24*b* of the electrical connectors 24. The cage surface 25 can be defined by the upper wall 26*a* of the cage 26. For instance, the cage surface can be an exterior surface, or upper surface, of the upper wall 26*a*. The cage surface 25 can alternatively be defined by any suitable alternative structure of the cage 26. To help maintain the cancellation force in the downward direction D3 (in a direction toward the substrate 10), the lock 36 can include a force cancellation member 48 that defines the force cancellation surface 46. For instance, the force cancellation surface 46 can be a downward facing surface of the force cancellation member 48. The force cancellation member 48 can be configured as a cross-beam that extends over the upper cage wall 26*a*, and thus over the cage surface 25. It should be appreciated that the force cancellation member 48 can alternatively or additionally include a spring, piston, or counterweight. In one example, the force cancellation member 48 can extend over the upper cage wall 26*a* along the lateral direction A, though it is appreciated that the force cancellation member 48 can extend over the upper cage wall 26*a* along any alternative direction as desired. For instance, the force cancellation member 48 can extend over the upper cage wall 26*a* along a direction that is parallel to the substrate 22 and the mounting interface 24*b*.

The electrical connector lock 36 can further include at least one attachment arm 50 that extends from the force cancellation member 48. The at least one attachment arm 50 can extend along a respective one of the sides 29*c* of the cage. At least a portion of the at least one attachment arm 50 up to an entirety of the at least one attachment arm 50 can extend down from the force cancellation member 48. Thus, the force cancellation member 48 can extend from the at least one attachment arm and across the surface 25 of the cage 26. The at least one attachment arm 50 can be located such that the electrical component 21 is disposed adjacent the at least one attachment arm 50 in any suitable direction. In one embodiment, the electrical component 21 is disposed adjacent the attachment arm in the lateral direction A. For instance, the electrical connector lock 36 can include first and second attachment arms 50 that extend from the force cancellation member 48. Thus, the force cancellation member 48 can extend from the first attachment arm 50 to the second attachment arm 50. The attachment arms 50 can extend directly or indirectly from the force cancellation member 48. The electrical component 21 can be disposed between the attachment arms 50 when the electrical connector lock 36 is mounted to the substrate 22. As illustrated in FIG. 1A, the electrical component 21 can be disposed between the attachment arms 50 with respect to the lateral direction A (e.g., perpendicular to the mating direction) when the electrical connector lock 36 is mounted to the substrate 22. For instance, the electrical component 21 can be aligned with one or both of the attachment arms 50 with respect to the lateral direction A when the electrical connector lock 36 is mounted to the substrate 22. Thus, at least one of the attachment arms 50 can extend along one of the sides 29*c* of the cage 26. At least one of the attachment arms can extend along the other one of the sides 29*c*.

The attachment arms 50 can support a mounting member 52 that is configured to attach to the substrate 22, so as to thereby attach the electrical connector lock 36 to the substrate 22. The mounting member 52 can be configured to attach to the substrate 22 in any manner desired. It should be appreciated that the attachment arms 50, the mounting member, and the force cancellation member 48 can be monolithic with each other, or attached to each other in any manner desired. For instance, the mounting member 52 can be configured as a mount tab 54 that extends out from each of the attachment arms 50. The mounting member 52 can define lock mount holes 56 that extend through the mount tabs 54. The lock mount holes 56 may be configured to receive any suitable fastener 58, which can be configured as a mount pin, screw, nail, rivet, or the like, that extends through the lock mount hole 56 and into the substrate 22. When the mounting member 52 is attached to the substrate, the electrical connector lock 36 is prevented from moving with respect to the substrate 10 in the upward direction D2. Alternatively or additionally, the force cancellation member 48 may also be fixed with respect to the cage 26, and in particular to the upper cage wall 26*a*, the substrate 22, or both. The force cancellation member 48, the attachment arms 50, and the mounting member 52 also help keep the cage 26 from being pried open along its seam. It should be appreciated that the electrical connector lock 36 may be separate from the cage 26 or monolithic with the cage 26.

Figure 2:
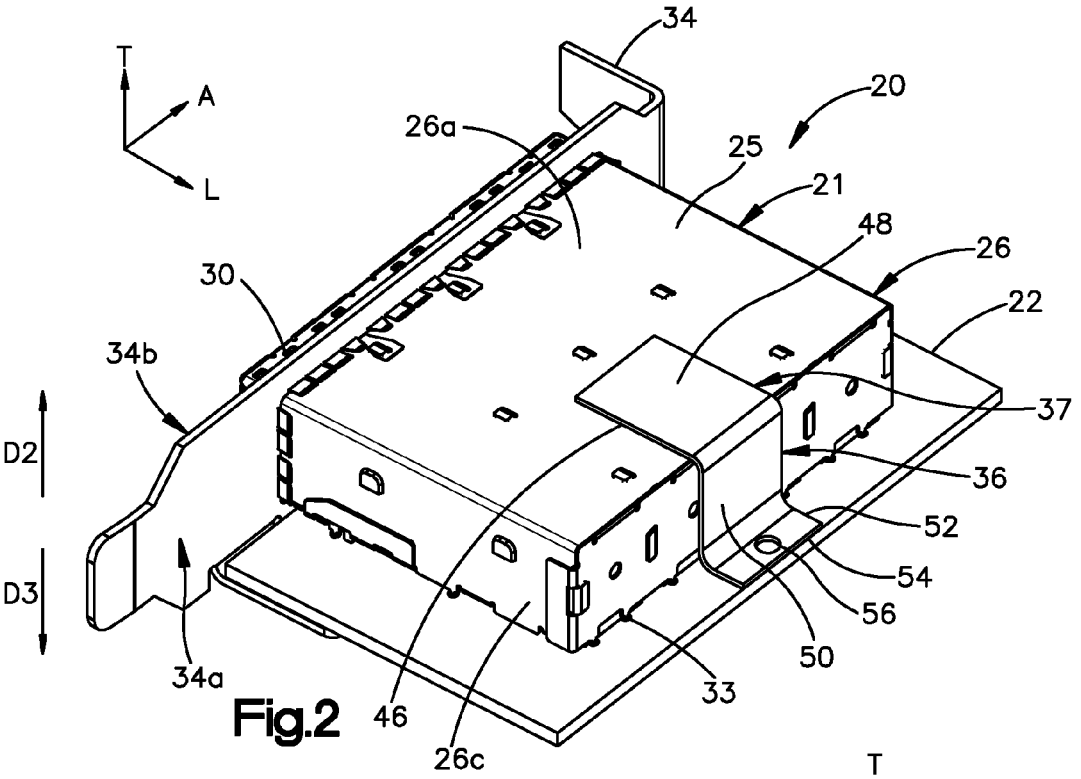
FIG. 2 is a top perspective side view of an electrical assembly similar to the electrical assembly illustrated in FIG. 1B, but including an electrical connector lock constructed in accordance with another embodiment.

It should be appreciated that the electrical connector lock 36 can be constructed in accordance with any suitable alternative embodiment as desired. For instance, referring now to FIG. 2, and as described above, the electrical connector lock 36 can include at least one attachment arm 50 that extends from the force cancellation member 48. Thus, the force cancellation member 48 can be cantilevered from the attachment arm 50. The at least one attachment arm 50 can be located such that the electrical component 21 is disposed adjacent the at least one attachment arm 50 in any suitable direction. For instance, the attachment arm 50 can extend along the rear end 29*b* of the cage 26. Thus, the electrical component 21 can be disposed adjacent the at least one attachment arm 50 along the longitudinal direction L, in a select direction that is defined from the first side 34*a* of the panel 34 to the second side of the panel 34*b*. The select direction can further be defined as a direction of movement of the at least one electrical connector 24 relative to the respective complementary electrical connector that mates the electrical connector 24 to the complementary electrical connector. Otherwise stated, the select direction can be the forward direction. For instance, the force cancellation member 48 can extend from the attachment arm 50 in the forward direction a distance such that the force cancellation member 48 terminates at a location between the attachment arm 50 and the panel 34 with respect to the longitudinal direction L. Alternatively, the force cancellation member 48 can extend to the panel 34. Alternatively or additionally still, the force cancellation member 48 can attach to the panel 34 as desired.

Figure 3A:
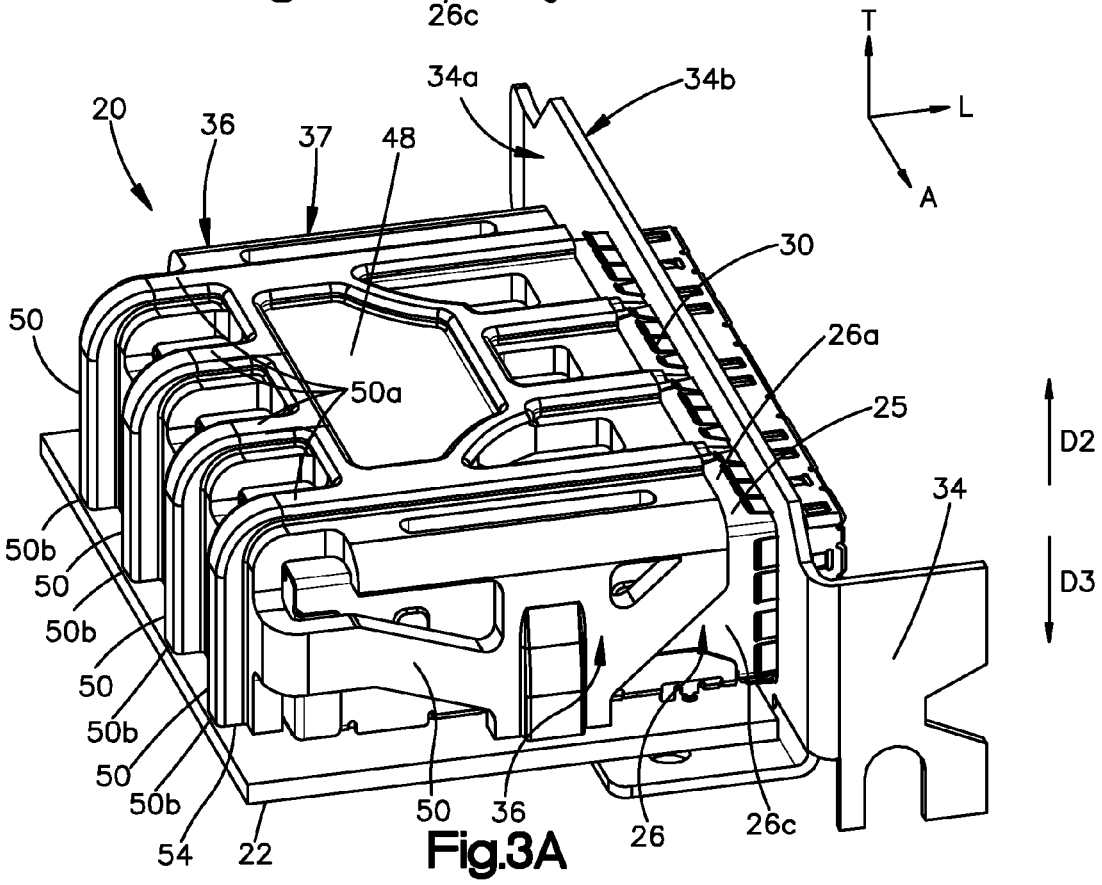
FIG. 3A is a perspective view of an electrical assembly similar to the electrical assembly illustrated in FIG. 1B, but including an electrical connector lock constructed in accordance with another embodiment.
Figure 3B:
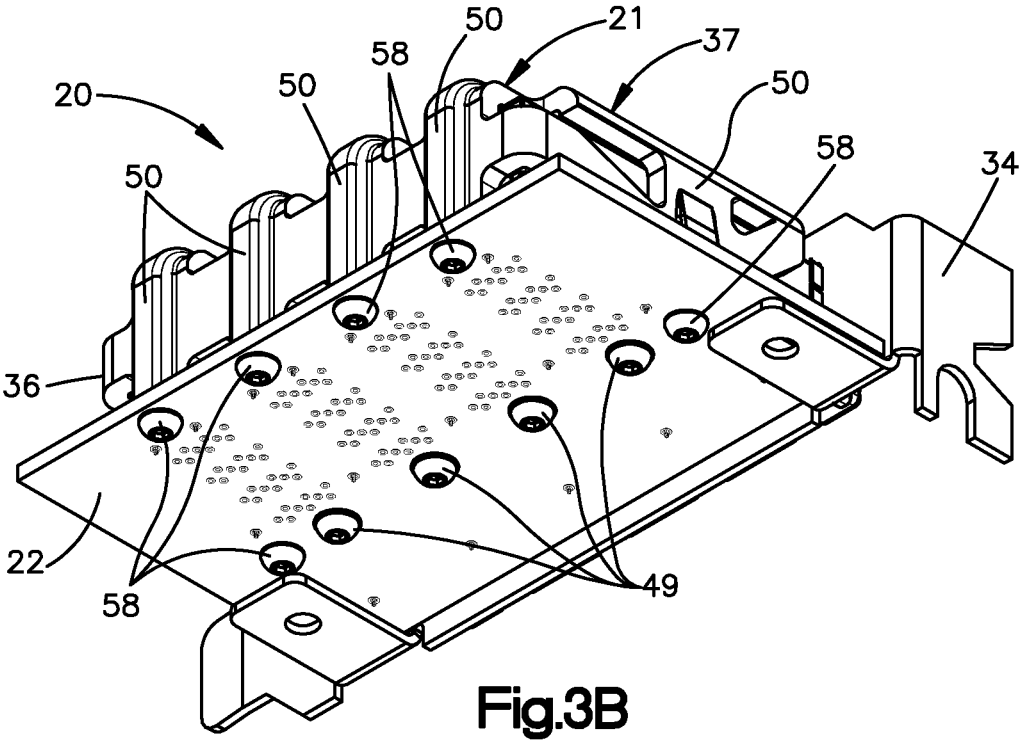
FIG. 3B is another perspective view of the electrical assembly illustrated in FIG. 3A.
Figure 3C:
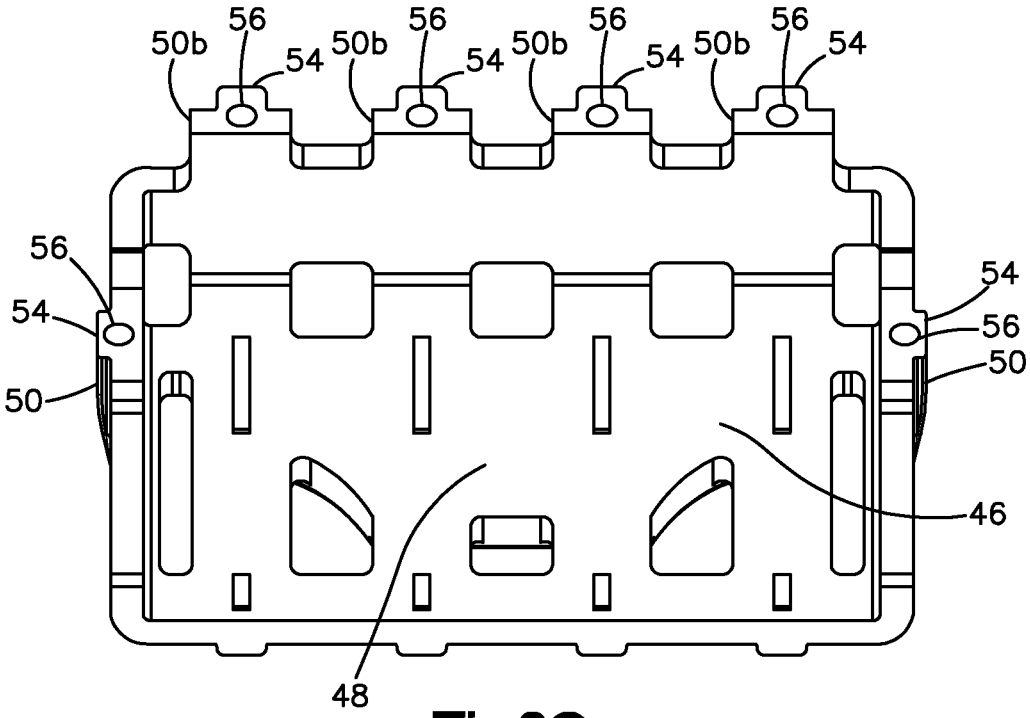
FIG. 3C is a bottom plan view of the electrical connector lock illustrated in FIG. 3A.
Figure 4A:
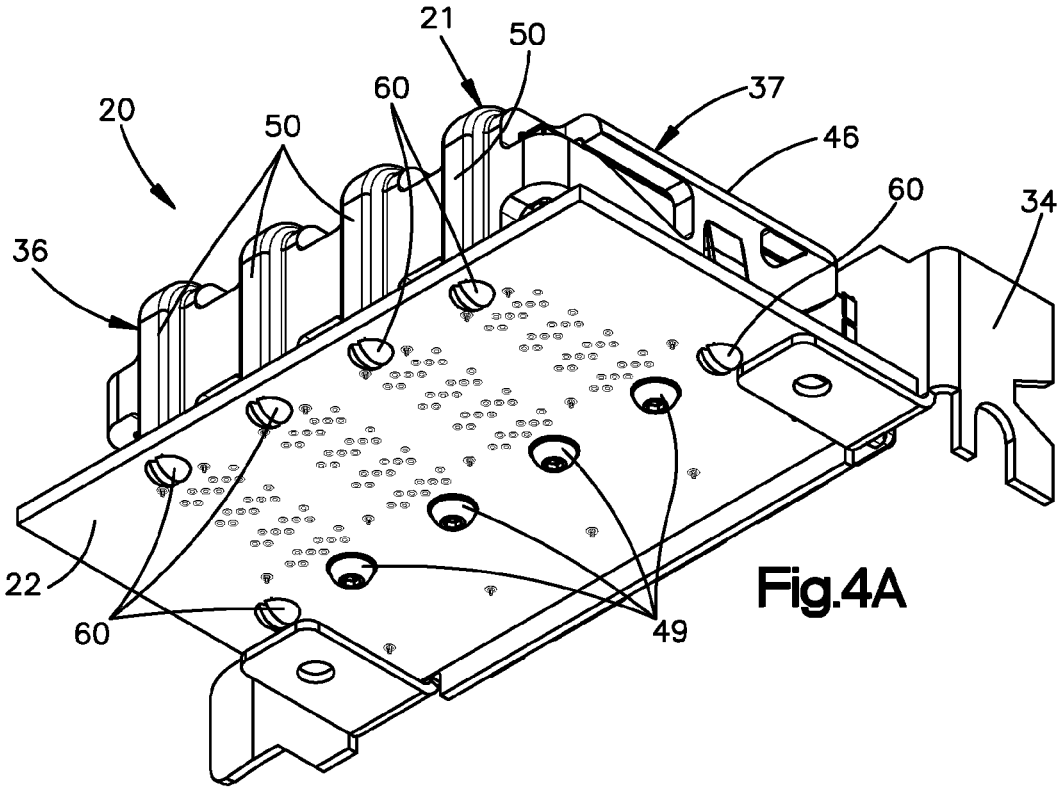
FIG. 4A is a perspective view of an electrical assembly similar to the electrical assembly illustrated in FIG. 3A, but including an electrical connector lock constructed in accordance with another embodiment.
Figure 4B:
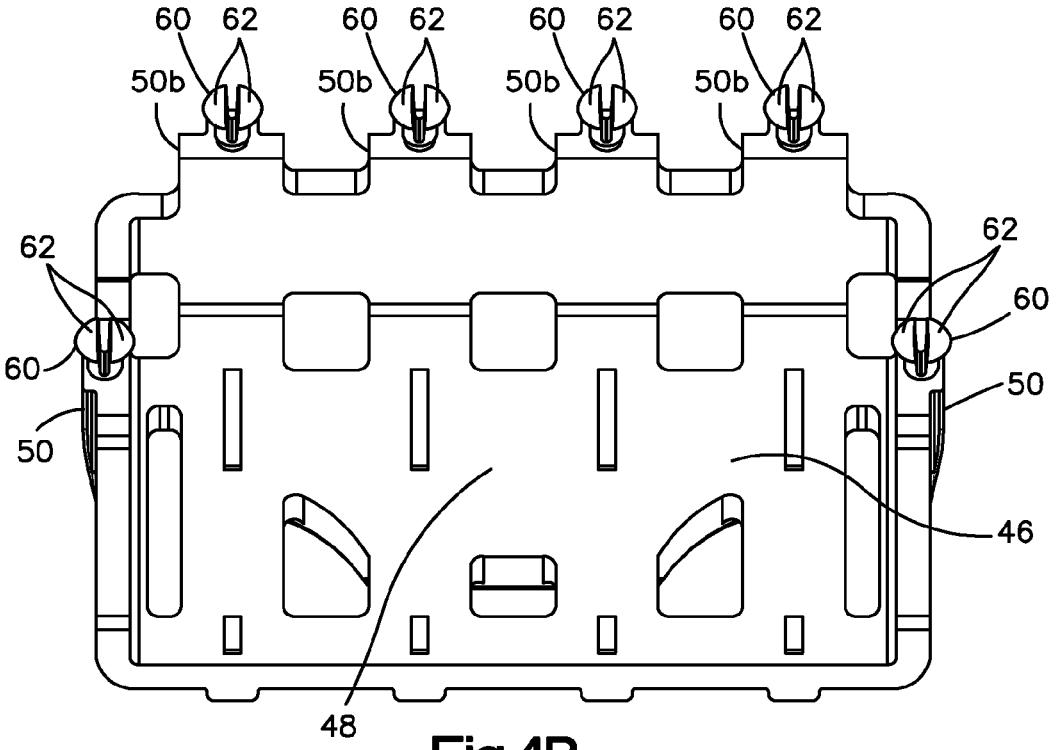
FIG. 4B is a bottom plan view of the electrical connector lock illustrated in FIG. 4A.

Referring now to FIGS. 3A-3C, and as described above, the force cancellation member 48 can define a force cancellation surface 46 that is configured to apply the cancellation force to the electrical component 21 in the downward force cancellation direction D3. The force cancellation surface 46 can cover at least a portion of the surface 25, such as a majority of the surface 25. It should be appreciated, of course, that the force cancellation surface 46 can cover an entirety of the surface 25. Thus, it can be said that the force cancellation surface 46 can cover at least a portion of the surface 25 up to an entirety of the surface 25. Further, the electrical connector lock 36 can include a plurality of attachment arms 50. A portion of the attachment arms 50 can extend along the surface 25, and a portion of the attachment arms 50 can extend down to the substrate 22. At least one of the attachment arms 50 can extend along the rear end 29*b* of the cage 26. Alternatively or additionally, at least one of the attachment arms 50 can extend along one of the sides 29*c* of the cage 26. Alternatively or additionally still, at least one of the attachment arms 50 can extend along the other one of the sides 29*c* of the cage 26. Each of the attachment arms 50 can define a respective proximal end 50*a* that extends from the force cancellation member 48, and a free distal end 50*b*.

As described above, the attachment arms 50 can support a mounting member 52 that is configured to attach to the substrate 22, so as to thereby attach the electrical connector lock 36 to the substrate 22. The mounting member 52 can be configured to attach to the substrate 22 in any manner desired. For instance, the mounting member 52 define lock mount holes 56 that extend upward into the distal ends 50*b* of the attachment arms 50. The lock mount holes 56 may be configured to receive any suitable fastener 58, which can be configured as a mount pin, screw, that extends through the substrate 22 and into the lock mount hole 56 so as to secure the electrical connector lock 36 to the substrate 22. When the mounting member 52 is attached to the substrate, the electrical connector lock 36 is prevented from moving with respect to the substrate 10 in the upward direction D2. Alternatively or additionally, the force cancellation member 48 may also be fixed with respect to the cage 26, and in particular to the upper cage wall 26*a*, the substrate 22, or both. The force cancellation member 48, the attachment arms 50, and the mounting member 52 also help keep the cage 26 from being pried open along its seam. It should be appreciated that the electrical connector lock 36 may be separate from the cage 26 or monolithic with the cage 26.

It should be appreciated that the mounting members 52 can be constructed in accordance with any suitable alternative embodiment as desired. For instance, the mounting members 52 can be configured as protrusions 60 in the form of pins that extend from the distal end 50*b* of the respective attachment arms 50. The protrusions 60 can define split fingers 62 that compress toward each other as they are inserted through respective apertures of the substrate 22, and flex outward away from each other after insertion through the substrate 22 so as to secure the electrical connector lock 36 to the substrate. In particular, the protrusions 60 can capture the printed circuit board between distal ends of the fingers 62 and the distal ends 50*b* of the attachment arms 50.

It should be appreciated that methods can be provided to lock an electrical connector to the substrate 22. The method can include the steps of attaching the electrical connector lock 36 to the substrate in accordance with any embodiment described herein. For instance, the method can include the steps of mounting at least one electrical connector 24 to the substrate 22, and attaching the cage 26 to the substrate 22 such that the cage 26 substantially surrounds the at least one electrical connector 24. The method can further include the step of attaching the electrical connector lock 36 to the substrate 22, such that the force cancellation member 48 extends along the surface 25 of the cage 26 at a location such that at least a portion of the cage 26 is disposed between the force cancellation member 48 and the substrate 22. The method can further include the step of receiving at the electrical connector 24 a separation force from a complementary electrical connector that is mated with the electrical connector 24, and applying a cancellation force from the force cancelation member 48 to the surface 25 of the cage 26 that is opposite the separation force.

Further, the method can include the steps of teaching a third party to prevent connector or cage disengagement through the use of the electrical connector lock 36 as described herein, and selling to the third party the electrical connector lock 36 constructed in accordance with any embodiment as desired. The method can further include the steps of selling to the third party one or more up to all of the at least one electrical connector 24 and the cage 26. The method can further include the steps of selling to the third party the at least one transceiver 42. The method can further include the steps of selling to the third party the substrate 22. The method can further include the steps of selling to the third party the panel 45.

In one example, the method can include the steps of teaching the at least one electrical connector 24 mounted to the substrate 22 at the first side 34*a* of the panel 34, and teaching the cage 26 attached to the substrate 22 such that the cage 26 substantially surrounds the at least one electrical connector 24. The method can further include the step of selling the electrical connector lock 36 that is configured to attach to the substrate 22, such that the force cancellation member 48 extends along a surface of the cage 26 at a location such that at least a portion of the cage 26 is disposed between the force cancellation member 48 and the substrate 22. The method can further include the step of teaching that the force cancellation member 36 is configured to apply the cancellation force to the surface 25 of the cage 26 in response to the separation force applied to the at least one electrical connector 24 that urges the electrical connector 24 away from the substrate.

Also included is method that may comprise the steps of advertising the electrical connector lock 36 that helps prevent the removal of the at least one electrical connector 24 or the cage 26 from the substrate 22 as described herein, and offering the electrical connector lock 36 for sale for use with the electrical connector 24, the cage 26, or both the electrical connector 24 and the cage 26.

The embodiments described in connection with the illustrated embodiments have been presented by way of illustration, and the present invention is therefore not intended to be limited to the disclosed embodiments. Furthermore, the structure and features of each the embodiments described above can be applied to the other embodiments described herein, unless otherwise indicated. Accordingly, the invention is intended to encompass all modifications and alternative arrangements included within the spirit and scope of the invention, for instance as set forth by the appended claims.

What is claimed is:

1. An electrical assembly comprising:

an electrical component, including at least one right-angle electrical connector having a mounting interface configured to be mounted to a substrate in a transverse direction, and a mating interface configured to mate with a complimentary electrical connector in a longitudinal direction, perpendicular to the transverse direction;

a panel configured to be mounted to the substrate, the panel having a first side, and a second side opposite the first side, the panel defining an opening that extends through the panel from the first side to the second side, wherein the electrical component is configured to be supported by the first side of a panel, and the at least one right-angle electrical connector is configured to mate with the complementary electrical connector at the second side of the panel opposite the first side, such that the at least one right-angle electrical connector is configured to receive the separation force from the complementary electrical connector; and an electrical connector lock having at least one mounting member that is configured to attach to the substrate and a force cancellation member supported by the at least one mounting member, wherein the electrical connector lock is configured to capture at least a portion of the electrical component between the force cancelation member and the substrate, and wherein the force cancellation member extends along a surface of the electrical component so as to apply a cancellation force to the surface in a first direction that is opposite an applied separation force to the electrical component that urges the electrical connector away from the substrate, the separation force being caused by a moment that is created when a force is applied in the first direction to the complementary electrical connector.

2. The electrical assembly as recited in claim 1, wherein the electrical component comprises a cage configured to attach to the substrate so as to at least partially surround the at least one electrical connector; and the surface comprises a surface of the cage, such that at least a portion of the cage and the at least one electrical connector is disposed between the force cancellation member and the substrate.

3. The electrical connector lock as recited in claim 1, wherein the mounting member defines an aperture configured to receive a fastener that extends into the substrate, so as to attach the electrical connector lock to the substrate.

4. The electrical connector as recited in claim 1, wherein the mounting member comprises a projection that extends from the attachment arm, the projection configured for insertion into the substrate.

5. The electrical assembly as recited in claim 1, wherein the electrical connector lock further comprises at least one attachment arm that extends from the force cancellation member, wherein the at least one attachment arm supports the mounting member.

6. The electrical connector lock as recited in claim 5, wherein the force cancellation member is cantilevered from the at least one attachment arm.

7. The electrical connector lock as recited in claim 5, wherein the at least one attachment arm comprises first and second attachment arms, and the force cancellation member extends from the first attachment arm to the second attachment arm.

8. The electrical connector lock as recited in claim 7, wherein the electrical component is disposed between the first and second attachment arms with respect to a direction that is perpendicular to a direction along which the electrical connector is mated to the complementary electrical connector.

9. A method comprising the steps of:

mounting at least one electrical connector and a cage onto a surface of a substrate along a direction that is perpendicular to the surface of the substrate such that the cage substantially surrounds the at least one electrical;

supporting the electrical connector at a first side of a panel;

attaching an electrical connector lock to the substrate, such that a force cancellation member of the electrical connector lock extends along a surface of the cage at a location such that at least a portion of the cage is disposed between the force cancellation member and the substrate, the at least one portion extending from a lower end of the cage to an upper end of the cage away from the surface of the substrate;

receiving the complementary electrical connector into the at least one electrical connector from a second side of the panel, opposite the first side, and through an opening that extends from the second side of the panel to the first side of the panel, and receiving at the electrical connector a separation force from a complementary electrical connector that is mated with the electrical connector such that the separation force is received at the second side of the panel; and applying a cancellation force from the force cancelation member to the surface of the cage that is opposite the separation force.

10. The method of claim 9, wherein the step of attaching the electrical connector lock to the substrate comprises attaching at least one mounting member of the electrical connector lock to the substrate such that the force cancellation member is supported by the at least one mounting member.

11. The method of claim 10, wherein the step of attaching the electrical connector lock to the substrate comprises attaching the at least one mounting member such that the force cancellation member is cantilevered from at least one attachment arm of the electrical connector lock that extends from the force cancellation member and supports the mounting member.

12. The method of claim 9, wherein the step of attaching the electrical connector lock to the substrate comprises attaching at least two mounting members of the electrical connector lock to the substrate such that the force cancellation member is supported by the at least two mounting members.

13. The method of claim 12, wherein the step of attaching the electrical connector lock to the substrate comprises disposing the electrical component between first and second attachment arms of the electrical connector lock with respect to a direction that is perpendicular to a direction along which the electrical connector is mated to the complementary electrical connector, wherein each of the at least two attachment arms extends from the force cancellation member and supports a respective one of the at least two mounting members.

* * * * *